US009526277B2

(12) United States Patent
Garneau

(10) Patent No.: US 9,526,277 B2
(45) Date of Patent: Dec. 27, 2016

(54) SEAT PAD FOR CYCLING GARMENT

(75) Inventor: Louis Garneau, St-Augustin-de-Desmaures (CA)

(73) Assignee: LOUIS GARNEAU SPORTS INC., Quebec (CA)

( * ) Notice: Subject to any disclaimer, the term of this patent is extended or adjusted under 35 U.S.C. 154(b) by 1252 days.

(21) Appl. No.: 13/511,911

(22) PCT Filed: Nov. 22, 2010

(86) PCT No.: PCT/CA2010/001829
§ 371 (c)(1), (2), (4) Date: Sep. 14, 2012

(87) PCT Pub. No.: WO2011/063503
PCT Pub. Date: Jun. 3, 2011

(65) Prior Publication Data

US 2013/0000025 A1 Jan. 3, 2013

Related U.S. Application Data

(60) Provisional application No. 61/264,278, filed on Nov. 25, 2009, provisional application No. 61/351,352, filed on Jun. 4, 2010.

(51) Int. Cl.
*A41B 9/00* (2006.01)
*A41B 9/02* (2006.01)
(Continued)

(52) U.S. Cl.
CPC ..... *A41D 1/084* (2013.01); *A41D 13/0537* (2013.01); *A41D 2600/104* (2013.01)

(58) Field of Classification Search
CPC ..... A41D 1/084; A41D 1/086; A41D 1/088; A41D 13/0537; A41D 2600/104; A41B 9/02; A41B 2300/20; A41B 2300/22; B62J 1/002; B62J 1/005; B62J 1/1007
(Continued)

(56) References Cited

U.S. PATENT DOCUMENTS 5,271,101 A * 12/1993 Speth ..... A41D 1/084 2/214
5,615,419 A * 4/1997 Williams ..... A42B 3/00 2/411
(Continued)

OTHER PUBLICATIONS

International Search Report: International Application No. PCT/CA2010/001829; International Application Filing Date Nov. 22, 2010; Mail date Mar. 10, 2011.
(Continued)

*Primary Examiner* — Anna Kinsaul
*Assistant Examiner* — Jameson Collier
(74) *Attorney, Agent, or Firm* — Cantor Colburn LLP

(57) ABSTRACT

A seat pad for a cycling garment includes a rear portion oriented to align with a buttocks region of a cyclist and an intermediate portion oriented to align with a perineum region of the cyclist, the rear portion being separated into two seat surfaces including a padded area and having an elongated groove extending from one of a front end or a rear end of the seat pad towards the intermediate portion, the elongated groove having a length longer than a width at the respective one of the front end and the rear end of the seat pad. It also relates to a cycling garment including the seat pad.

13 Claims, 5 Drawing Sheets

(51) Int. Cl.

| | |
|---|---|
| ***A41D 1/14*** | (2006.01) |
| ***A41D 13/015*** | (2006.01) |
| ***A62B 17/00*** | (2006.01) |
| ***A41D 1/08*** | (2006.01) |
| ***A41D 13/05*** | (2006.01) |

(58) Field of Classification Search
USPC ..... 2/401, 466, 215, 228, 455, 467, 78.3, 2/214, 79, 238, 267
See application file for complete search history.

(56) References Cited

U.S. PATENT DOCUMENTS

| | | | | |
|---|---|---|---|---|
| 5,978,970 | A | 11/1999 | Bright | |
| D452,764 | S * | 1/2002 | Garneau | D2/705 |
| 6,547,327 | B1 * | 4/2003 | Yates | B62J 1/22 297/200 |
| 6,687,917 | B2 | 2/2004 | Forsyth et al. | |
| 6,928,665 | B1 | 8/2005 | Yates | |
| 6,990,693 | B2 | 1/2006 | Reschewitz | |
| 2002/0029409 | A1 * | 3/2002 | Coccia | A41D 1/084 2/456 |
| 2003/0056282 | A1 * | 3/2003 | Coccia | A41D 1/084 2/466 |
| 2003/0079276 | A1 * | 5/2003 | Forsyth | A41D 1/084 2/267 |
| 2004/0143890 | A1 * | 7/2004 | Reschewitz | A41D 1/084 2/466 |
| 2005/0210570 | A1 | 9/2005 | Garneau | |
| 2005/0223478 | A1 * | 10/2005 | Hogan | A41D 1/084 2/466 |
| 2006/0048282 | A1 * | 3/2006 | Africa | A41D 1/084 2/267 |
| 2006/0277662 | A1 | 12/2006 | Coccia | |
| 2008/0229486 | A1 * | 9/2008 | Maier | A41D 1/084 2/401 |
| 2010/0095432 | A1 * | 4/2010 | Liou | A41D 1/084 2/227 |

OTHER PUBLICATIONS

Written Opinion; International Application No. PCT/CA2010/001829; International Application Filing Date Nov. 22, 2010; Mail date Mar. 10, 2011.

International Preliminary Report on Patentability International Application No. PCT/CA2010/001829; International Application Filing Date Nov. 22, 2010; Completion date Mar. 9, 2012.

* cited by examiner

SEAT PAD FOR CYCLING GARMENT

CROSS-REFERENCE TO RELATED APPLICATIONS

This application claims priority under 35 USC §119(e) of U.S. provisional patent applications 61/264,278 filed Nov. 25, 2009 and 61/351,352 filed Jun. 4, 2010, the specifications of which are hereby incorporated by reference.

FIELD OF THE INVENTION

The technical field relates to a seat pad for a pair of cycling pants and, more particularly, to a flexible seat pad for fitting onto the buttock, the lower abdominal, and perineum regions of a cyclist or any person wearing the seat pad.

DESCRIPTION OF THE PRIOR ART

Increased popularity of cycling, at both recreational and competitive levels, has resulted in a demand for high quality, low cost cycling apparels which are effective at providing the user with bodily comfort during sustained periods of cycling.

Particularly, considerable attempts have been made at developing cyclist pants which provide the cyclist with increased comfort during contact of the body with the cycle seat. Typically, during cycling, a substantial portion of the cyclist's body weight bears on the cycle seat. Additionally, when peddling, the cyclist's body undergoes considerable movement relative to the cycle seat resulting in frictional contact therebetween. Such weight bearing and prolonged frictional contact are known to cause certain discomforts including minor abrasions and, in some instances, more serious injuries suffered at the lower abdominal region of the cyclist.

Existing cyclist pants include multi-layered seat pads affixed to the inside crotch area of the pants. Such seat pads are designed to increase comfort by providing a padded buffer between the cyclist and the cycle seat during use. However, such known seat pads are often bulky and result in the unintended consequence of adding to the cyclist's discomfort upon the cycle seat. For instance, such seat pads are known to be less flexible than desired, thus increasing discomfort of the cyclist.

There is thus a need for a seat pad which combines both properties, i.e. cushioning where needed and sufficient flexibility.

SUMMARY OF THE INVENTION

It is an aspect of the invention to improve comfort of cyclists wearing cycling garments with seat pads.

It is therefore an aim of the present invention to address the above mentioned issues and to provide a seat pad and a cycling garment including the same which provide effective padding against contact with the cycle seat with an increased flexibility.

According to a general aspect, there is provided a seat pad for a cycling garment comprising: a front portion, an opposing rear portion, and an intermediate portion disposed between the front and rear portions, the rear portion having an elongated groove extending between two seat surfaces having padded areas from a rear end of the seat towards the intermediate portion, the elongated groove extending to a tip corresponding substantially to a coccyx tip of a cyclist wearing the cycling garment.

According to another general aspect, there is provided a seat pad for a cycling garment comprising a rear portion oriented to align with a buttocks region of a cyclist and an intermediate portion oriented to align with a perineum region of the cyclist, the rear portion being separated into two seat surfaces including a padded area and having an elongated groove extending between the seat surfaces from a rear end of the seat pad towards the intermediate portion, the elongated groove having a length longer than a width at the rear end of the seat pad.

According to another general aspect, there is provided a cycling garment comprising a seat pad having a rear portion oriented to align with a buttocks region of a cyclist and an intermediate portion oriented to align with a perineum region of the cyclist, the rear portion being separated into two seat surfaces including a padded area and having an elongated groove extending between the seat surfaces from a rear end of the seat pad towards the intermediate portion, a tip of the elongated groove extending substantially to a beginning of a rear end of a bicycle seat when a cyclist wearing the cycling garment is seated on the bicycle seat.

According to still another general aspect, there is provided a seat pad for a cycling garment comprising: a front portion, an opposing rear portion, and an intermediate portion disposed between the front and rear portions, the front portion having an elongated front groove extending from a peripheral edge of the seat pad towards the intermediate portion.

According to still another general aspect, there is provided a cycling garment comprising a seat pad with a front portion, an opposing rear portion, and an intermediate portion disposed between the front and rear portions, the rear portion having an elongated groove extending between two seat surfaces having padded areas, the elongated groove extending from a rear end of the seat pad towards the intermediate portion, the elongated groove having a tip which at least one of corresponds substantially to a coccyx tip of the cyclist wearing the cycling garment, is located forwardly of the coccyx tip of the cyclist wearing the cycling garment, and extends past a middle point of the seat surfaces along a longitudinal axis of the seat pad and towards the intermediate portion.

In an embodiment, the elongated groove extends along the longitudinal axis of the seat pad and has a length along the longitudinal axis longer than a width along a peripheral edge of the seat pad. The length of the elongated groove can range between seven and thirteen centimeters (7-13 cm) and the width of the elongated groove at the rear end of the seat pad ranges between 0.5 and five centimeters (0.5-5 cm). The elongated groove can be V-shaped and can define an angle ranging between five and thirty degrees (5-30°).

In an embodiment, the seat pad comprises a fabric piece attached thereto and covering the elongated groove, the fabric piece having a higher elasticity than the adjacent seat surfaces of the seat pad. In other words, the fabric piece is more stretchable than the adjacent seat surfaces of the seat pad. The fabric piece can comprise a single fabric layer and the adjacent seat surfaces of the seat pad can comprise at least two material layers superposed to one another. The adjacent seat surfaces of the seat pad can comprise at least a top fabric layer superposed to a bottom fabric layer and the material of the fabric piece can be different from the material of the top and the bottom fabric layers. The seat pad can comprise inner edges defining the elongated groove and the fabric piece can comprise corresponding lateral edges adjacent to a respective one of the inner edges of the seat pad, the inner edges of the seat pad and the fabric piece moving freely relatively to the cycling garment. In other words, the lateral edges of the seat pad and the fabric piece can be unattached to the cycling garment. The seat pad can be secured to the cycling garment at a peripheral edge thereof and the fabric piece can be secured to the cycling garment at a rear edge thereof.

According to still another general aspect, there is provided a seat pad for a cycling garment comprising a rear portion oriented to align with a buttocks region of a cyclist, an intermediate portion oriented to align with a perineum region of the cyclist, and a front portion extending forwardly of the intermediate portion, at least one of the rear portion and the front portion having at least one elongated groove aligned substantially along a longitudinal axis of the seat pad and extending inwardly from a peripheral edge of the seat pad, the at least one elongated groove having a length along the longitudinal axis longer than a width along the peripheral edge of the seat pad.

In an embodiment, the rear portion is separated into two seat surfaces including a padded area and one of the at least one elongated groove extends between the seat surfaces from the peripheral edge of the seat pad towards the intermediate portion, the padded areas having a length along the longitudinal axis and the elongated groove extends past a middle point of the padded area length towards the intermediate portion.

In an embodiment, the seat pad further comprises a fabric piece attached to the seat pad and covering the at least one elongated groove, the fabric piece having a higher elasticity than sections of the seat pad adjacent to the at least one elongated groove. The fabric piece can connect opposed inner edges of the seat pad defining the at least one elongated groove and the fabric piece can be thinner than the sections of the seat pad adjacent to the at least one elongated groove.

The fabric piece can be an elastic single layered fabric and the adjacent sections of the seat pad can comprise at least two material layers superposed to one another. The fabric piece can comprise meshed material.

According to still another general aspect, there is provided a cycling garment, comprising the above described seat pad. The seat pad can comprise inner edges defining the at least one elongated groove and the inner edges can be unattached to the cycling garment. The seat pad can comprise a fabric piece mounted to the seat pad and covering the at least one elongated groove, the fabric piece being secured to the cycling garment at a peripheral end thereof.

According to still another general aspect, there is provided a cycling garment comprising a seat pad having a rear section oriented to align with a buttocks region of a cyclist, an opposed front section and an intermediate section extending therebetween, the seat pad having a longitudinal axis extending from the front section towards the rear section and a substantially triangularly-shaped section extending inwardly from a peripheral edge of the seat pad in at least one of the front section and the rear section, the triangularly-shaped section being oriented along substantially the longitudinal axis and having two inner edges extending on each side of the longitudinal axis, the triangularly-shaped section creating a discontinuity by being more extensible than adjacent seat pad sections.

In an embodiment, the triangularly-shaped section has a length along the longitudinal axis longer than a width along the peripheral edge of the seat pad.

In an embodiment, the rear portion is separated into two seat surfaces including a padded area and the triangularly-shaped section extends between the seat surfaces from the peripheral edge of the seat pad towards the intermediate portion, the padded areas having a length along the longitudinal axis and the triangularly-shaped section extends past a middle point of the padded area length towards the intermediate portion.

In an embodiment, the triangularly-shaped section comprises an elastic fabric piece connecting opposed inner edges of the seat pad adjacent to the lateral edges of the triangularly-shaped section, the fabric piece being thinner than the adjacent seat pad sections. The fabric piece can be an elastic single layered fabric and the adjacent seat pad sections can comprise at least two material layers superposed to one another. The fabric piece can comprise meshed material. The inner edges of the seat pad and the lateral edges of the fabric piece can be unattached to the cycling garment and the fabric piece can be secured to the cycling garment at a peripheral end thereof.

The triangularly-shaped section can have a tip which at least one of corresponds substantially to a coccyx tip of the cyclist wearing the cycling garment, can be located forwardly of the coccyx tip of the cyclist wearing the cycling garment, and can extend past a middle point of the seat surfaces along a longitudinal axis of the seat pad and towards the intermediate portion.

The length of the triangularly-shaped section can range between seven and thirteen centimeters (7-13 cm) and the width of the triangularly-shaped section at the peripheral edge of the seat pad can range between 0.5 and five centimeters (0.5-5 cm).

The triangularly-shaped section can be V-shaped and can define an angle ranging between five and thirty degrees (5-30°).

BRIEF DESCRIPTION OF THE DRAWINGS

It will be noted that throughout the appended drawings, like features are identified by like reference numerals.

DETAILED DESCRIPTION

Figure 1:
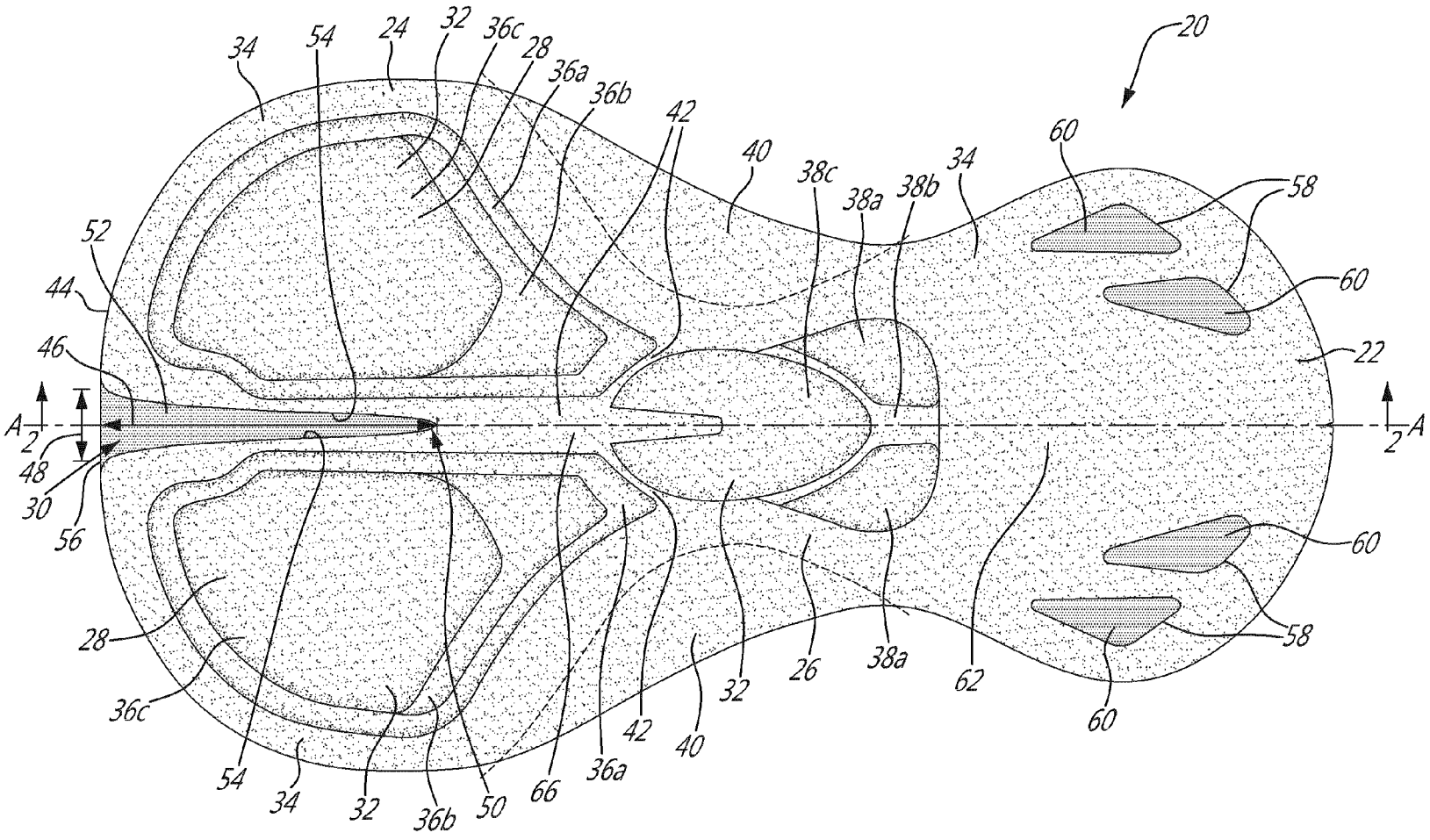
FIG. 1 is a top plan view of a cyclist seat pad in accordance with an embodiment, wherein a fabric piece is mounted in an elongated groove defined between two seat surfaces including cushioning pads.

FIG. 1 shows an embodiment of a cyclist seat pad 20, which is a padded element intended to be disposed in a cycling garment 68 (FIG. 3), or cycling pants, for providing a cyclist with enhanced comfort while sitting upon and riding a bicycle or the like. The seat pad is also referred to as a chamois or a chamois lining.

The term "cycling garment" is intended to mean cycling pants, shorts or knicks, bicycling pants, shorts or knicks, baggy shorts or pants, bib shorts or pants, and other similar items.

The seat pad includes a front portion 22, an opposing rear portion 24, and an intermediate portion 26 disposed between the front and rear portions 22 and 24, respectively. The front portion 22 is generally U-shaped and is designed to contact and support the lower abdominal region (or the lower pelvic region) of the cyclist. The rear portion 24 of the seat pad 20 is somewhat bird tail-shaped and is substantially wider than the front portion 22. The rear portion 24 is generally oriented to align with the buttocks region of the cyclist and includes two seat surfaces 28 spaced-apart from one another. As it will be described in more details below, a rear elongated groove 30 extends between the two seat surfaces 28. The intermediate portion 26 serves to connect the front and rear portions 22 and 24, respectively, and includes curvilinear contouring along sides thereof. When the seat pad 20 is properly utilized by the cyclist, the intermediate portion 26 contacts the perineum region, between the legs, and upper thigh regions thereof.

Central padded areas 32 are disposed centrally on the seat pad 20. In the embodiment shown, the padded areas 32 are located in the intermediate portion 26 and the rear portion 24. However, in an alternative embodiment (not shown), the padded areas 32 can also be located in the front portion 22 to provide additional support and padding to the cyclist's lower pelvic area.

The seat pad 20 further includes an outer area 34 which extends substantially around a periphery of the padded areas 32. The padded areas 32 include padding, as discussed further herein, and are substantially thicker than the outer area 34. The outer area 34 may include padding similar to that of the padded areas 32 or, alternatively, the outer area 34 may be relatively flat, or have differing degrees of padding.

The padded areas 32 include two spaced-apart buttocks padded areas 36 disposed and designed for contact with the buttocks of the cyclist. The padded areas 32 further include a perineum padded area 38 extending forwardly from the buttocks padded areas 36 along a longitudinal axis A-A into the intermediate portion 26 of the seat pad 20. The perineum padded area 38 is intended for contact with the perineum area of the cyclist.

Figure 5:
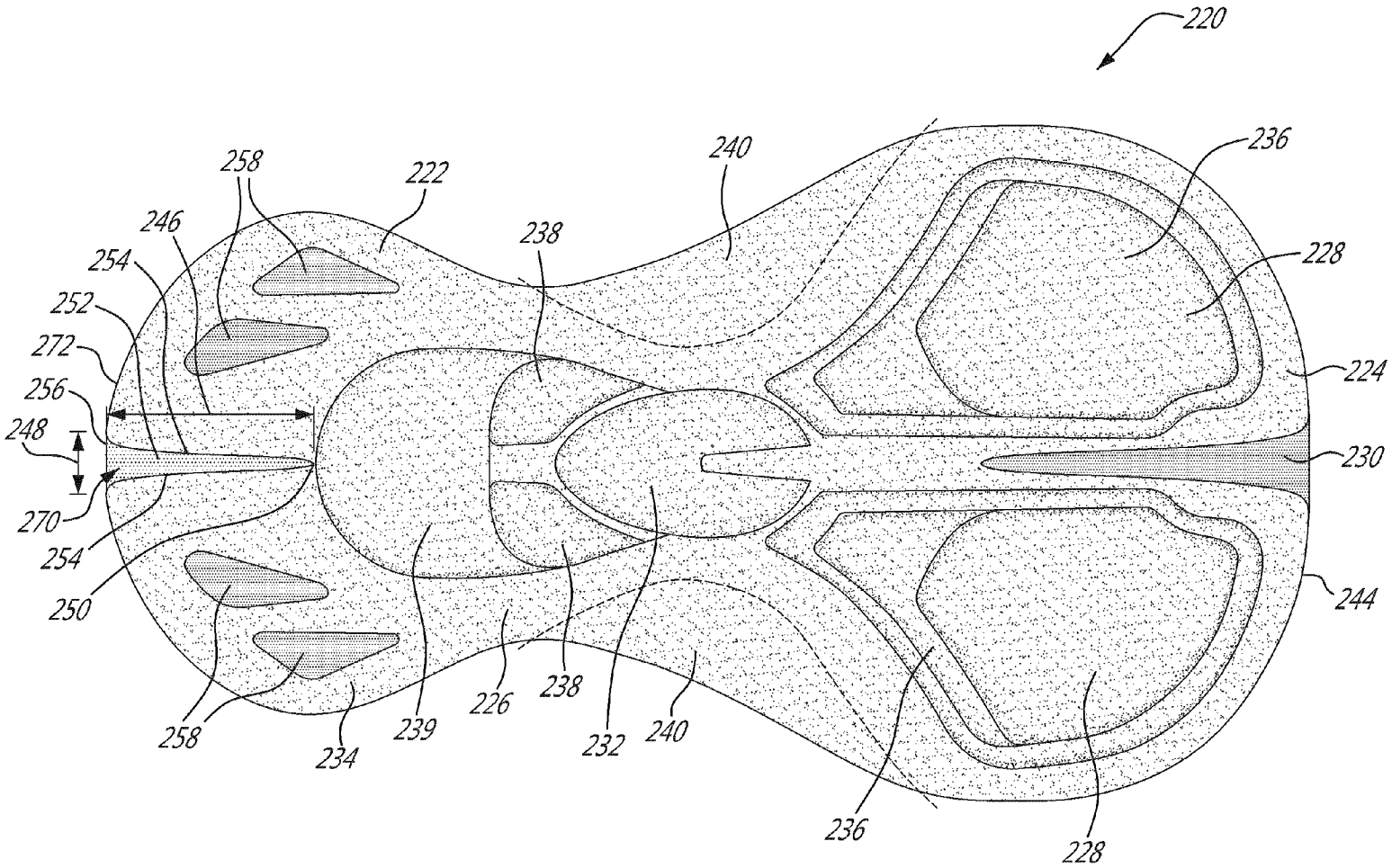
FIG. 5 is a top plan view of a cyclist seat pad in accordance with another embodiment and including an elongated groove extending in a front portion of the seat pad.

The padded areas 32 can further include a front padded area 239, as shown in FIG. 5, designed to contact and support the lower abdominal region (or the lower pelvic region) of the cyclist. The front padded area 39 extends forwardly of the perineum padded area 38.

One skilled in the art will appreciate that the shape, number, and configuration of padded areas can vary from the one shown in the accompanying drawings.

As mentioned above, the outer area 34 extends around the padded areas 32 and includes side wings 40 disposed generally at the intermediate portion 26 of the seat pad 20, adjacent to the perineum padded area 38. The side wings 40 can be pre-shaped (or pre-tensioned), i.e. extending downwardly into a concave shape, to provide snug anatomical conformation to the cyclist's perineum and upper thigh regions, again enhancing overall comfort.

Thinned hinge lines 42 separate the buttocks padded areas 36 from the perineum padded area 38. The thinned hinge lines 42 are portions of the seat pad 20 having a reduced thickness. The thinned hinge lines 42 allow an area of the seat pad 20 to pivot, or otherwise move, relative to another portion. In alternative embodiments (not shown), additional thinned hinge lines can traverse a perimeter of the padded areas 32 separating the same from the outer area 34 and further thinned hinge lines can extend across the outer area 34 or within the padded areas 32.

The hinge lines 42 can be formed by permanently compressing the padded areas 32 to obtain the desired reduced thickness thereof. For instance, the compression can be achieved by heat treatment or by a high frequency fusion treatment.

While the thinned hinged lines 38 are described herein and throughout with regard to specific dispositions thereof on the seat pad 20, this is in no way intended to limit the scope of the formation and the positioning of the hinge lines 42. As mentioned, such lines 42 provide the seat pad 20 with an advantageous degree of flexibility. Accordingly, the thinned hinge lines 42 may be disposed at any position on the seat pad 20 as desired to provide enhanced flexibility thereto, addition comfort and/or to bring any additional advantages thereof to the seat pad 20.

Figure 2:
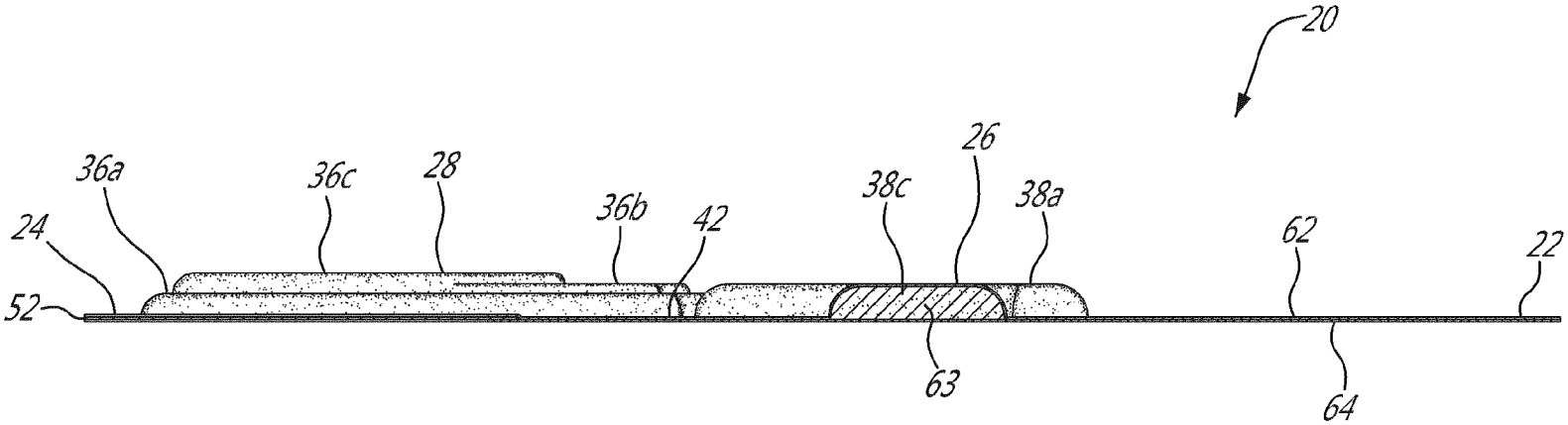
FIG. 2 is a sectional view along section lines 2-2 of the cyclist seat pad shown in FIG. 1.

In an embodiment, the seat pad 20 is a multi-layered element including an inner (or top) layer 62, a middle layer 63, and an outer (or bottom) layer 64 as shown in FIG. 2. The top layer 62 contacts the body of the cyclist during use of the seat pad 20, 120, the bottom layer is directly superposed to a cycling garment 68 opposite the body of the cyclist, and the middle layer 63 is disposed between the top and bottom layers 62, 64, respectively.

While various individual layers of the seat pad 20 are herein specified, this description is only exemplary and is not intended to limit or otherwise narrow the invention. The seat pad 20 may include any number of layers in any potential combination thereof as desired for achieving the comfort properties and padding provided by the seat pad 20. Further, it shall be understood that the layers composing the seat pad 20 may individually be formed of a uniform, monolithic material construction or, alternatively, such layers may themselves be composed of a plurality of material layers. Thus when describing and reciting "a layer" of the seat pad 20 herein, any of these constructions are contemplated, as well as combinations and variations thereof. In another alternative embodiment, the seat pad 20 can include two layers a top layer and a bottom layer, which is also a padding layer.

The top layer 62 is generally composed of a cloth-like material. That is, the top layer 62 includes a thin, generally non-compressible, woven fibrous material formed of, for example, polyester such as brushed micro-fiber polyester. The top layer 62 includes a thickness of approximately 0.2 to four millimeters (0.2-4 mm) and, in another embodiment, approximately 0.3 to two millimeters (0.3-2 mm).

The middle layer 63 is a padding layer and can be composed of thick compressibly resilient open-cell foam, such as polyurethane or another "air breathing" material, or appropriate gels. The middle layer 63 includes a thickness of approximately ten to fifteen millimeters (10-15 mm). In the embodiment of the seat pad 20, the foam padding material composing the middle layer 63 may include a plurality of layers, as further described in US patent application no. 2007/0174953, incorporated herein by reference in its entirety. Furthermore, the foam density can vary within the seat pad 20.

The bottom layer 64 is composed of a cloth-like material. That is, the bottom layer 64 includes a thin, generally non-compressible, woven fibrous material formed of a synthetic polymer, such as a polyamide, for example nylon. The bottom layer 64 includes a thickness of approximately 0.2 to two millimeters (0.2-2 mm) and, in another embodiment, approximately 0.3 to one millimeter (0.3-1 mm).

The top layer 62, the middle layer 63, and the bottom layer 64 are fixed together to form the multi-layered seat pad 20. The various layers are fixed together in any sufficient manner which establishes a lasting bond therebetween. For example, the layers may be temperature bonded, high frequency fusion bonded, affixed together by use of an ultrasound gun, adhered together with an adhesive such as glue, etc. During this bonding process the materials of the various layers may be compressed or otherwise made smaller as desired to achieve a final seat pad 20 of a specific thickness. For example, top, middle, and bottom layers having original thicknesses of one millimeter (1 mm), fifteen millimeters (15 mm), and one millimeter (1 mm), respectively, may be compressed or reduced to form into the seat pad 20 having a maximum thickness of approximately fifteen millimeters (15 mm) or less.

Thus to define the several padded areas 32, outer area 34, and hinge lines 38 having distinct thicknesses, the multi-layered seat pad 20 can be in a fully expanded state in few regions, a partially compressed state in other regions, and in a compressed state in still other regions.

Furthermore, the seat pad 20 fabricated as discussed above, can include a plurality of regions having distinct thicknesses due to overlapping or non-overlapping of the top, middle, and bottom layers. That is, due to the varying shapes and sizes of the layers composing the seat pad 20, some areas of the pad 20 include all three layers overlapped and in an uncompressed state and thus include a maximum thickness, while other areas of the pad do not include all of the layers overlapped upon each other, partially compressed, entirely compressed or uncompressed, and thus these areas include a reduced thickness.

In a particular embodiment, the front portion 22 of the seat pad 20 has a thickness of approximately two millimeters (2 mm). The side wings 40 of the intermediate portion 26 have a thickness of approximately one millimeter (1 mm). The front and external padded areas 38*a* and the rear padded area 38*c* of the intermediate portion 26 have a thickness of approximately twelve millimeters (12 mm) and the front and internal padded area 38*b* extending between the external padded areas 38*a* has a thickness of approximately ten millimeters (10 mm). The padded areas 36 of the seat surfaces 28 have an increasing thickness from the peripheral padded area 36*a* to the central padded area 36*c*. More particularly, in the embodiment shown, the peripheral padded areas 36*a* of the seat surfaces 28 have a thickness of approximately seven millimeters (7 mm), the intermediate padded areas 36*b* of the seat surfaces 28 have a thickness of approximately twelve millimeters (12 mm), and the central padded areas 36*c* of the seat surfaces 28 have a thickness of approximately fifteen millimeters (15 mm). The section 66 extending between the seat surfaces 28 has a thickness of approximately one millimeter (1 mm). It is appreciated that the thicknesses given above are exemplary only. The materials composing the various regions of the pad 20, and the construction thereof, provide the cyclist with sufficient support, enhanced padding against shock and impact, increased flexibility, temperature control, and moisture absorption and evacuation.

As exemplified above, the padded areas 32 and the outer areas 34 contouring the padded areas 32 are relatively thick. Therefore, the flexibility of this seat pad 20 in the rear portion 24 is relatively limited. During the pedaling operation, as a first leg, for instance the right leg, is extended, the corresponding right buttock member moves downwardly in response thereto and at the same time that the right leg is extended, the left leg moves upwardly by a proportional amount. Similarly, the left buttock member moves upwardly in proportion to the downwardly movement of the right buttock member. Thus, for a cyclist's comfort, the seat pad 20 should be flexible enough to follow the buttock movements.

As shown in FIG. 1, the elongated groove 30 is provided between the two seat surfaces 28 to increase the flexibility of the rear portion 24 of the seat pad 20. The groove 30 extends from a rear end 44 of the seat pad 20 towards the intermediate portion 26 of the seat pad 20. The groove 30 is defined between the two seat surfaces 28 and between their corresponding padded areas 36. In the embodiment shown, the groove 30 is relatively long and narrow and the elongated groove 30 has a length 46 longer than a width 48 at the rear end 44 of the seat pad 20, or along a peripheral edge of the seat pad. In the embodiment shown, the groove is a notch, i.e. it is a V-shaped cut. In an embodiment, the groove 30 has a tip 50 which substantially corresponds to a coccyx tip of a cyclist wearing the cycling garment 68 including the seat pad. In an alternative embodiment, the tip 50 is located forwardly of the coccyx tip of the cyclist, towards the perineum region. In an embodiment, the tip 50 corresponds substantially to the beginning of the seat pad portion extending between the cyclist's perineum/buttocks and the bicycle seat when a cyclist wearing the seat pad is seated on the bicycle seat, i.e. the elongated groove does not extend in the seat pad portion extending between the cyclist's perineum/buttocks and the bicycle seat. In other words, the tip 50 of the elongated groove 30 extends substantially to a beginning of a rear end of a bicycle seat when a cyclist wearing the cycling garment including the seat pad 20 is seated on the bicycle seat. The length 46 of the elongated groove 30 from the rear end 44 of the seat pad 20 to the tip ranges between about seven and thirteen centimeters (7-13 cm), in an alternative embodiment, the length 46 of the elongated groove 30 is between about nine and eleven centimeters (9-11 cm). The width 48 at the rear end 44 (at the peripheral edge of the seat pad) of the seat pad 20 ranges up to five centimeters (5 cm), in an alternative embodiment, the width 48 of the elongated groove 30 is between about two and four centimeters (2-4 cm). In an embodiment, the elongated groove is an elongated cut defined in the seat pad 20. The elongated groove 30 defines an angle ($\alpha$) between about five and thirty degrees (5-30°), in an alternative embodiment, the angle ($\alpha$) is between about ten and twenty-five degrees (10-25°).

In an embodiment, the padded areas 36 in the seat surfaces 28 have a length along the longitudinal axis A-A of the seat pad 20 and the elongated groove 30 extends past a middle point of the padded area length, towards the intermediate portion 26.

In the embodiment shown in FIG. 1, a fabric piece 52 extends in the elongated groove 30 and connects the seat surfaces 28. In an embodiment, the fabric piece 52 has a higher elasticity than the adjacent seat surfaces 28 of the seat pad 20, i.e. the fabric piece 52 is more stretchable than the adjacent seat surfaces 28. The elastic properties of the fabric piece 52 are enhanced in comparison with the properties of the material(s) composing the padded areas 36 and the outer areas 34 adjacent to the fabric piece 52. In an embodiment, the fabric piece 52 is single layered. In an embodiment, the fabric piece 52 is thinner than the padded areas 36 of the seat pad 20. It is also thinner or has substantially the same thickness as the outer areas 34 contouring the padded areas 36 for enhanced flexibility. For instance and without being limitative, the fabric piece 52, which in the embodiment is a substantially elastic material, can be a meshed material. Thus, the groove 30 with mesh material extending therein also enhances the aeration properties of the seat pad 20. The perforations in the mesh material increase air and moisture exchange.

In an embodiment, the fabric piece 52 is made of material(s) different than materials of the top, middle, and bottom fabric layers 62, 63, 64 of the seat pad 20.

In an embodiment, a rear end 56 (or peripheral edge) of the fabric piece 52, in continuation with the peripheral edge of the seat pad 20, is attached to the edge of cycling garment 68 in which the seat pad 20 is mounted and the two opposed inner edges 54 defining the groove 30 and adjacent and corresponding lateral edges of the fabric piece 52 are not attached to the cycling garment 68, i.e. they can move relatively to the cycling garment 68. In the embodiment shown, the rear end 56 of the fabric piece 52 is stitched to the cycling garment 68. In an alternative embodiment, the inner edges 54 of the seat pad 20 and/or the lateral edges of the fabric piece 52 can also be stitched to the cycling garment 68. It is appreciated that in an alternative embodiment, the rear end 56 and the inner edges 54 of the seat pad 20 and/or the lateral edges of the fabric piece 52 can be attached to the cycling garment 68. In another alternative embodiment, only the inner edges 54 of the seat pad 20 and/or the lateral edges of the fabric piece 52 can be attached to the cycling garment 68.

Figure 3:
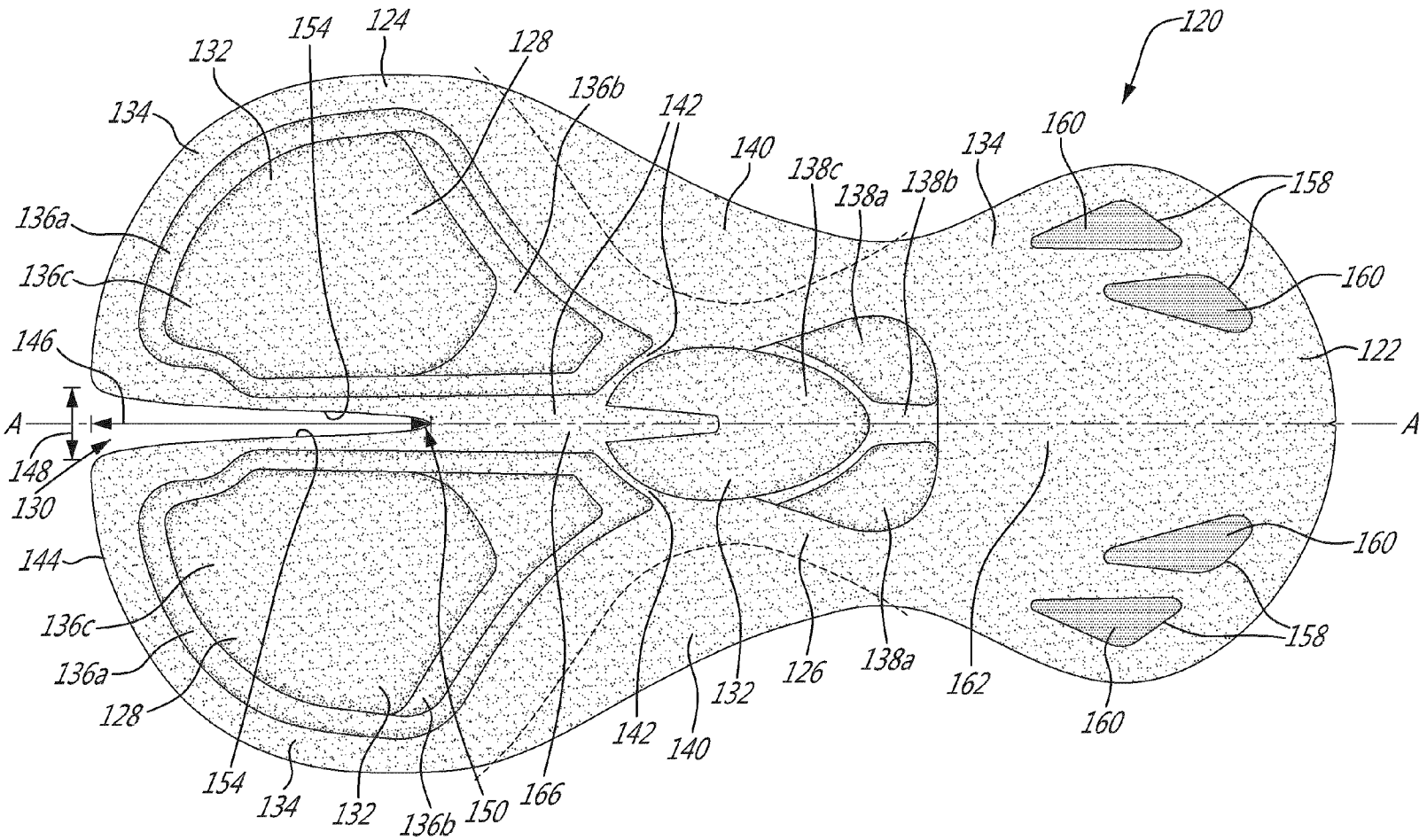
FIG. 3 is a top plan view of a cyclist seat pad in accordance with another embodiment, wherein the V-shaped groove defined between the two seat surfaces is material free.

Referring now to FIG. 3, there is shown another embodiment shown wherein the features are numbered with reference numerals in the 100 series which correspond to the reference numerals of the previous embodiment. In FIG. 3, the elongated groove 130 is free of any material extending between its two opposed inner edges 154, i.e. the two inner edges are not connected through a fabric piece. The inner edges 154 of the seat pad 120 may or may not be attached, for instance stitched, to the cycling garment 68 (FIG. 4) in which the seat pad 120 is inserted.

In an embodiment (not shown), sew lines extend through the seat pad 120 and the cycling garment 68 along the inner edges 154. In an alternative embodiment, the sew line(s) that extend(s) along the peripheral edge of the seat pad 120 ends at a rear end of the groove 30 and the inner edges 154 are not sewed to the cycling garment 68.

The seat pad 20, 120 220 further includes aeration windows 58, 158, 258 defined in the front portion 22, 122 222. In the embodiment shown, the aeration window 58, 158, 258 exposes a piece of mesh material 60, 160 having perforations therein for an increased air and moisture exchange between the cyclist's side of the seat pad 20, 120, 220 and an opposite outer side and vice versa.

Mesh material 60, 160 is a synthetic or fabric-like perforated flexible material which perforation units are each of a size and shape enabling free bodily heat release and free humidity escape therethrough. Furthermore, mesh material is usually a relatively elastic fabric.

It is appreciated that, in an alternative embodiment (not shown), the aeration window 58, 158, 258 can be free of any material, i.e. it exposes the cycling garment 68 when mounted thereto, or it can expose any other fabric.

In alternative embodiments (not shown), the seat pad 20, 120 may include other perforations or aeration windows which extend entirely therethrough to provide ventilation during use of the seat pad 20, 120. Such ventilation allows airflow to move from the cyclist's side of the seat pad 20, 120 to an opposite outer side and vice versa. This airflow cools the cyclist and allows fluid evaporation to thus keep the cyclist dry for enhanced comfort. Furthermore, the perforations and aeration windows are sized and disposed to allow the passage of fluid, that is, perspiration, rainwater, etc., which has accumulated on the seat pad 20, 120 against the cyclist's body, and which is permitted to drain from the cyclist's side of the pad to the outer, exterior side. The seat pad 20, 120 is typically disposed in a cycling pant formed of a moisture wicking material. Thus, the fluid which drains through the perforations and aeration windows to the outer side of the pad is promptly wicked to an exterior of the pant away from the cyclist's body. This provides enhanced comfort and dryness. Additionally, the perforations and aeration windows reduce the overall weight of the seat pad 20, 120 and provide increased flexibility thereof, thus enhancing comfort to the cyclist. The perforations may include a recess, i.e. a generally planar surface of a reduced thickness relative to the remainder of the padded areas.

Referring now to FIG. 5, there is shown another embodiment wherein the features are numbered with reference numerals in the 200 series which correspond to the reference numerals of the previous embodiment. The seat pad 220 of FIG. 5 includes a front elongated groove 270 extending substantially parallel to the longitudinal axis A-A in the front portion 222 of the seat pad 220. As the rear elongated groove 230, the front elongated groove 270 increases the flexibility of the front portion 222 of the seat pad 220. The groove 270 extends from a front end 272 of the seat pad 220 (or the peripheral edge of the seat pad 220) towards the intermediate portion 226 of the seat pad 220. The groove 270 separates the front portion 222 into two portions. In the embodiment shown, the groove 270 is a relatively long and narrow notch, i.e. a V-shaped cut, with a length 246 longer than its width 248 at the front end 272 (or peripheral edge) of the seat pad 220. In an embodiment, the groove 270 has a tip 250 which is located approximately at the junction of the outer area 234 and an adjacent padded area 239. It is appreciated that in alternative embodiments, the groove 270 can extend in the inner padded area(s) 239 or can be shorter. In the embodiment shown, the tip 250 corresponds substantially to the beginning of the seat pad padded area 239 having an increased thickness. The length 246 of the elongated groove 270 from the front end 272 of the seat pad 220 to the tip ranges between about three and thirteen centimeters (3-13 cm), in an alternative embodiment, the length of the elongated groove 270 is between about five and ten centimeters (5-10 cm). The width 248 at the front end 272 of the seat pad 220 ranges up to about five centimeters (5 cm), in an alternative embodiment, the width 248 of the elongated groove 270 is between about one and four centimeters (1-4 cm). In an embodiment, the elongated groove 270 is an elongated cut defined in the seat pad 220. The elongated groove 270 defines an angle ($\alpha$) between about five and thirty degrees (5-30°), in an alternative embodiment, the angle ($\alpha$) is between about ten and twenty-five degrees (10-25°).

In the embodiment shown in FIG. 5, a fabric piece 252, such as the one described above in reference to the rear groove 30, extends in the elongated groove 270 and connects the two front portions. In an embodiment, the fabric piece 252 has a higher elasticity than the adjacent front portions of the seat pad 220, i.e. the fabric piece 252 is more stretchable than the adjacent front portions. The elastic properties of the fabric piece 252 are enhanced in comparison with the properties of the material(s) composing the padded areas 239 and the outer areas 234 adjacent to the fabric piece 252. The fabric piece 252 can be single layered and/or thinner than the padded areas 239 of the seat pad 220 and the adjacent front portions of the seat pad 220. It is also thinner or has substantially the same thickness as the outer areas 234 contouring the padded areas 236, 239 for enhanced flexibility. In an embodiment, the elastic properties of the fabric piece are enhanced in comparison with the properties of the material(s) composing the padded areas 236, 239 and the outer areas 234. For instance and without being limitative, the fabric piece 252 can be a meshed material. Thus, the groove 270 with mesh material extending therein also enhances the aeration properties of the seat pad 220. The perforations in the mesh material increase air and moisture exchange.

In an embodiment, the fabric piece 252 is made of material(s) different than materials of the top, middle, and bottom fabric layers 262, 263, 264 of the seat pad 220.

In an embodiment, a front end (or peripheral edge) of the fabric piece 252, in continuation with the peripheral edge of the seat pad 220, can be secured to a cycling garment (not shown) in which the seat pad 220 is mounted and the two opposed inner edges 254 defining the groove 270 and adjacent and corresponding lateral edges of the fabric piece 252 are not attached to the cycling garment, i.e. they can move relatively to the cycling garment. In the embodiment shown, the front end of the fabric piece 252 is stitched to the cycling garment. In an alternative embodiment, the inner edges 254 of the seat pad 220 and/or the lateral edges of the fabric piece 252 can also be stitched to the cycling garment. It is appreciated that in an alternative embodiment, the front end and the inner edges 254 of the seat pad 220 and/or the lateral edges of the fabric piece 252 can be attached to the cycling garment. In another alternative embodiment, only the inner edges 254 can be secured to the cycling garment, or any combinations thereof.

In an alternative embodiment (not shown), the elongated groove 270 can be free of any material extending between its two opposed inner edges 254, i.e. the two inner edges 254 are not connected. The inner edges 254 of the seat pad 220 may or may not be attached, for instance stitched, to the cycling garment to which the seat pad 220 is mounted.

It is appreciated that combinations of the above-described seat pads 20, 120, 220 can be made. For instance and without being limitative, a seat pad can include one or several front and rear elongated grooves 30, 130, 230, 270, with or without a fabric piece 252 extending therein. It can also include aeration windows 58, 158, 258.

Figure 4:
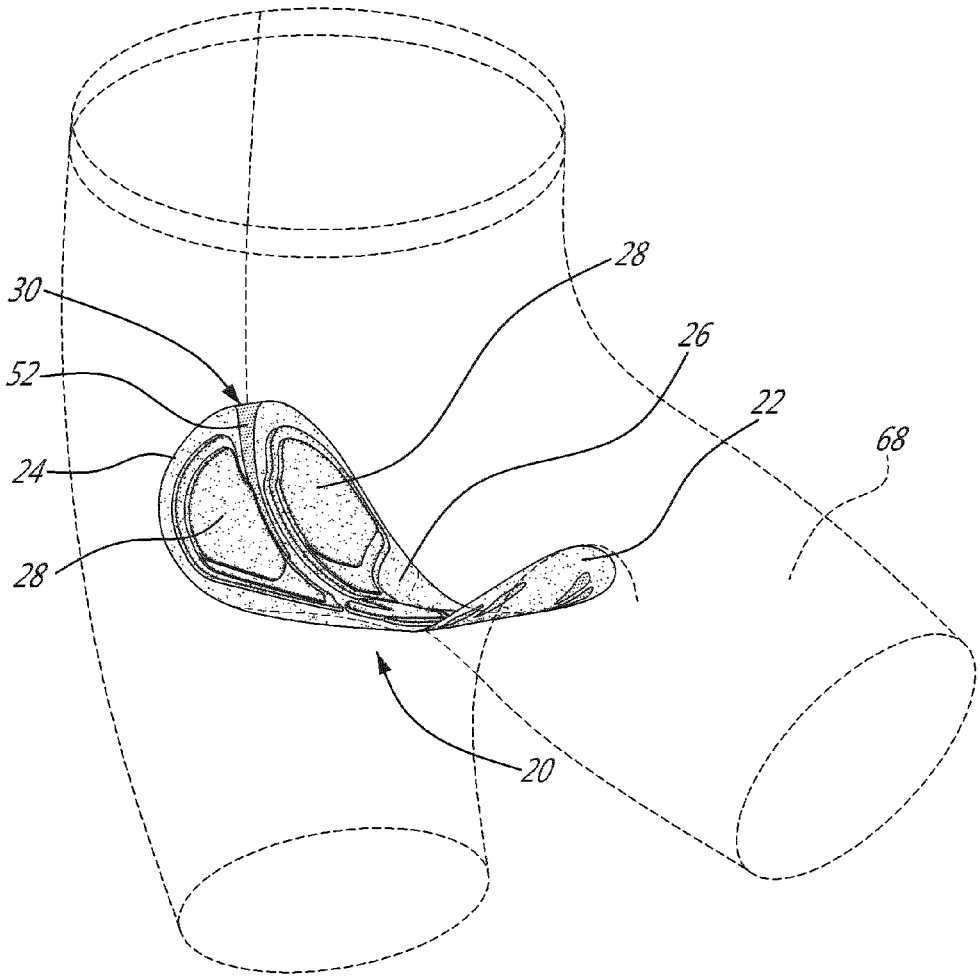
FIG. 4 is a perspective view of the cyclist seat pad shown in FIG. 1 disposed in a cycling garment.

The seat pad 20, in one embodiment, is secured to the cycling garment 68 as shown in FIG. 4. The garment 68 includes any clothing item to be worn by the cyclist proximate the groin and crotch area such as, for example, underwear, cycling pants, shorts or knicks, bicycling pants, shorts or knicks, baggy shorts or pants, bib shorts or pants, etc. The seat pad 20 is fixed to the cycling garment 68 by any suitable method including, but not limited to, stitching, temperature or fusion bonding, adhering with a bonding agent, etc., and any combination thereof. If stitching is used for fixing the seat pad to the cycling garment stretch stitches can be used.

When the seat pad 20 is mounted to the cycling garment 68, the inner edges 54 defining the groove 30 and/or the rear end 56 may or may not be secured to the cycling garment 68.

It is appreciated that the design of the seat pad 20, 120, including the shape, position, and thickness of the padded areas, can differ from the above described and illustrated embodiments. The design of the seat pad can be adapted to the cyclist's gender and anatomy. For instance and without being limitative, a female seat pad is generally thinner and smaller than a male seat pad.

The seat pad has been generally described herein as being a member mounted within a pant to be worn by a cyclist, etc. Alternatively, however, the construction of the seat pad may be formed integrally within the pant. That is, it is not required that the seat pad be an element separate from the pant. The pad and its unique features may be formed integrally within the material forming the pant.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A cycling garment comprising a garment configured to cover a lower body of a cyclist, the cycling garment further comprising a seat pad with a front portion, an opposing rear portion, and an intermediate portion disposed between the front and rear portions, the rear portion having an elongated groove extending between two seat surfaces having padded areas, the elongated groove extending from a rear end of the seat pad towards the intermediate portion, the elongated groove having a tip having a location that is configured to be any one of (i) at a coccyx tip of the cyclist wearing the cycling garment, (ii) forwardly of the coccyx tip of the cyclist wearing the cycling garment, and (iii) past a middle point of the seat surfaces along a longitudinal axis of the seat pad and towards the intermediate portion; a fabric piece being located in the elongated groove, the fabric piece having a higher elasticity than the two seat surfaces of the seat pad.

2. A cycling garment as claimed in claim 1, wherein the elongated groove extends along the longitudinal axis of the seat pad and a length of the elongated grove along the longitudinal axis is longer than a width of the elongated groove.

3. A cycling garment as claimed in claim 2, wherein the length of the elongated groove ranges between seven and thirteen centimeters and the width of the elongated groove at the rear end of the seat pad ranges between 0.5 and five centimeters.

4. A cycling garment as claimed in claim 3, wherein the elongated groove is V-shaped and defines an angle ranging between five and thirty degrees.

5. A cycling garment as claimed in claim 1, wherein the fabric piece comprises a single fabric layer and the two seat surfaces of the seat pad each comprise at least two material layers superposed to one another.

6. A cycling garment as claimed in claim 5, wherein the two seat surfaces of the seat pad each comprise at least a top fabric layer superposed to a bottom fabric layer and the material of the fabric piece is different from the materials of the top and the bottom fabric layers.

7. A cycling garment as claimed in claim 1, wherein the seat pad comprises inner edges defining the elongated groove and the fabric piece comprises corresponding lateral edges individually adjacent to a respective one of the inner edges of the seat pad, the inner edges individually of the seat pad and the fabric piece being configured to move freely and relatively within the cycling garment.

8. A cycling garment as claimed in claim 1, wherein a peripheral edge of the seat pad is secured within the cycling garment and a rear edge of the fabric piece is secured within the cycling garment.

9. A cycling garment, comprising pants, a seat pad in the pants having a rear portion configured to be oriented to align with a buttocks region of a cyclist, an intermediate portion oriented to align with a perineum region of the cyclist, and a front portion extending forwardly of the intermediate portion, at least one of the rear portion and the front portion having at least one elongated groove positioned along a longitudinal axis of the seat pad and extending inwardly from a peripheral edge of the seat pad, the at least one elongated groove having a length along the longitudinal axis longer than a width of the at least one elongated groove, a fabric piece being located in the at least one elongated groove, the fabric piece having a higher elasticity than the two seat surfaces of the seat pad.

10. A cycling garment as claimed in claim 9, wherein the seat pad comprises inner edges defining the at least one elongated groove and the inner edges are not directly attached to the pants of the cycling garment.

11. A cycling garment as claimed in claim 9, wherein, a peripheral end of the fabric piece is secured within the cycling garment.

12. A cycling garment comprising pants, a seat pad in the pants having a rear section configured to be oriented to align with a buttocks region of a cyclist, an opposed front section and an intermediate section extending between the front and rear sections, the seat pad having a longitudinal axis extending from the front section towards the rear section, at least one elongated groove extending between two seat surfaces having padding areas, and an elastic fabric piece defining a triangularly-shaped section extending inwardly from a peripheral edge of the seat pad in the at least one elongated groove in at least one of the front section and the rear section, the elastic fabric piece being positioned along the longitudinal axis and having two inner edges respectively extending on each side of the longitudinal axis to connect to respective inner edges of the seat pad, the elastic fabric piece being made of a material more extensible than a material of the rear intermediate and front seat pad sections.

13. A cycling garment as claimed in claim 12, wherein the triangularly-shaped section has a length along the longitudinal axis longer than a width of the triangularly-shaped section along the peripheral edge of the seat pad.

* * * * *